US006203457B1

(12) United States Patent
Snook

(10) Patent No.: US 6,203,457 B1
(45) Date of Patent: Mar. 20, 2001

(54) TWISTED NOCK AND FEATHER SYSTEM FOR ARCHERY ARROWS

(76) Inventor: Nicholas M. Snook, 165 S. Fourth St., Hughesville, PA (US) 17737

( * ) Notice: Subject to any disclaimer, the term of this patent is extended or adjusted under 35 U.S.C. 154(b) by 0 days.

(21) Appl. No.: 09/467,464

(22) Filed: Dec. 20, 1999

(51) Int. Cl.[7] ..... F42B 6/06
(52) U.S. Cl. ..... 473/586
(58) Field of Search ..... 473/578, 586, 473/FOR 216, FOR 223; 124/91

(56) References Cited

U.S. PATENT DOCUMENTS

| | | | | |
|---|---|---|---|---|
| 2,209,672 | | 7/1940 | Boggs . | |
| 2,277,743 | * | 3/1942 | Crossman | 473/586 |
| 3,658,335 | | 4/1972 | Saunders . | |
| 5,039,110 | * | 8/1991 | Honda | 473/586 |

* cited by examiner

*Primary Examiner*—John A. Ricci

(74) *Attorney, Agent, or Firm*—John J. Elnitski, Jr.

(57) ABSTRACT

The present invention provides different embodiments of a nock and feather system which decreases the drag on an arrow in flight and reduces the cost of making an arrow. All of the embodiments employ a twist nock having a front end, a rear end and a surface area between the front end and rear end. The front end of the twist nock includes a hollow portion for inserting and securing a rear end of an arrow to the twist nock. The rear end of the twist nock includes a slot to receive a bow string. The slot is defined by two sets of two edges and two rear surfaces between the sets. Each edge has a first end and a second end. The slot is a twisted opening have a pitch of about ninety-degrees per inch. The pitch is defined by the position of the first end in relation to the second end of each of the edges. When an arrow having the twist nock is fired from a bow, the arrow begins to spin due to the twisted opening and not due to the feathers. That is because it takes a bit of time for an arrow to spin due to the feathers alone, whereas the twist nock puts an instant spin on the arrow when the twist nock leaves the bow string. The instant spin on the arrow is caused by the twisted opening, whereby the twist nock must twist or spin in order to release itself from the bow string when fired. The feathers are disclosed in different locations of the arrow and nock.

15 Claims, 4 Drawing Sheets

TWISTED NOCK AND FEATHER SYSTEM FOR ARCHERY ARROWS

BACKGROUND

There have been many attempts at improving the nock on an archery arrow to improve the flight of the arrow. Most of these attempts have failed to focus on the feathers attached to the shaft of an arrow. The feathers on the shaft of the arrow present an economic problem as well a drag problem. Economically, feathers increase the cost of an arrow due to cost of materials and due to the cost manufacturing in order to fletch the feathers onto the shaft of the arrow. The drag problem stems from the size of the feather needed to stabilize the arrow in flight. Stabilization of the arrow in flight requires the feathers to use the air flow around the arrow to spin the arrow shaft. The problem lies in that the bigger the feather, the more drag is produced in flight. This drag inhibits the velocity an arrow can move through the air, but without the feathers the arrow would not fly very far. The disclosure of one of the prior art nocks speaks to the elimination of feathers from the arrow. The complete removal of the feathers has been found to be ineffective for producing an arrow which can fly in a straight path for any distance. In fact that same disclosure states that the path of the arrow is comparatively straight, meaning it is not a true straight spinning path that the arrow flies when it leaves the bow.

It is an objective of the present invention to reduce the size feather required on an arrow shaft using an improved nock and feather system.

It is another objective of the present invention to eliminate the fletching of feathers on the arrow shaft, thereby reducing the cost of arrow manufacturing.

It is another objective to decrease the drag on an arrow, thereby increasing the velocity of the arrow in flight.

SUMMARY OF THE INVENTION

The present invention provides different embodiments of a nock and feather system which decreases the drag on an arrow in flight and reduces the cost of making an arrow. All of the embodiments employ a twist nock having a front end, a rear end and a surface area between the front end and rear end. The front end of the twist nock includes a hollow portion for inserting and securing a rear end of an arrow to the twist nock. The rear end of the twist nock includes a slot to receive a bow string. The slot is defined by two sets of two edges and two rear surfaces between the sets. Each edge has a first end and a second end. The slot is a twisted opening have a pitch of about ninety-degrees per inch. The pitch is defined by the position of the first end in relation to the second end of each of the edges. When an arrow having the twist nock is fired from a bow, the arrow begins to spin due to the twisted opening and not due to the feathers. That is because it takes a bit of time for an arrow to spin due to the feathers alone, whereas the twist nock puts an instant spin on the arrow when the twist nock leaves the bow string. The instant spin on the arrow is caused by the twisted opening, whereby the twist nock must twist or spin in order to release itself from the bow string when fired. The feathers are disclosed in different locations of the arrow and nock.

DETAILED DESCRIPTION

Figure 1:
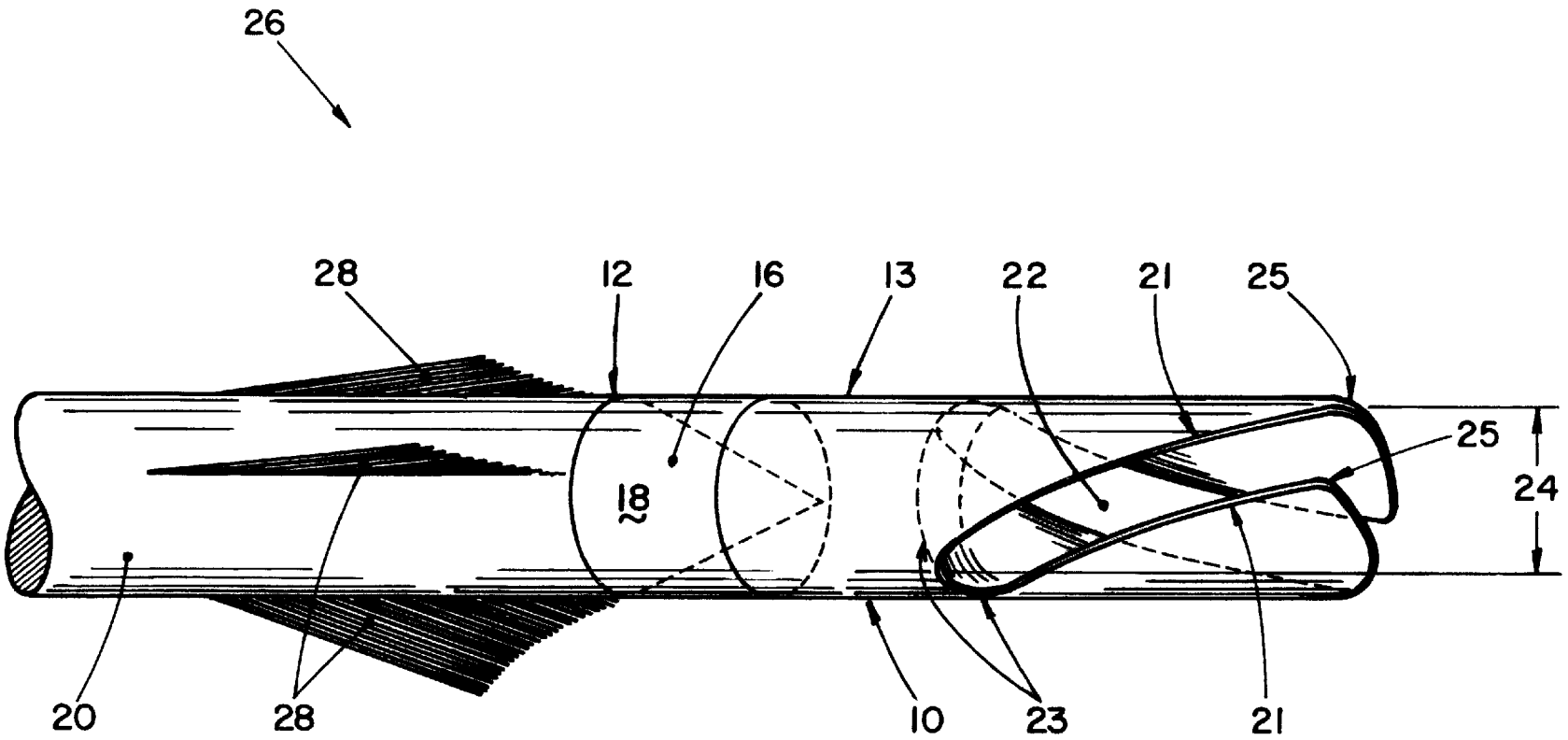
FIG. 1 is perspective view of an embodiment of the present invention.

The present invention provides different embodiments of a nock and feather system which decreases the drag on an arrow in flight and reduces the cost of making an arrow. All of the embodiments employ a twist nock 10 having a front end 12, a rear end 14 and a surface area 13 between the front end 12 and rear end 14, as shown in FIG. 1. The front end 12 of the twist nock 10 includes a hollow portion 16 for inserting and securing a rear end 18 of an arrow 20 to the twist nock 10. The rear end 14 of the twist nock 10 includes a slot 22 to receive a bow string. The slot 22 is defined by two sets of two edges 21 and two rear surfaces 19 between the sets. Each edge 21 has a first end 23 and a second end 25. The slot 22 is shown as a twisted opening having a pitch 24 of about ninety-degrees per inch. The pitch 24 is defined by the position of the first end 23 in relation to the second end 25 of each of the edges 21. When an arrow having the twist nock 10 is fired from a bow, the arrow begins to spin due to the twisted opening and not due to the feathers. That is because it takes a bit of time for an arrow to spin due to the feathers alone, whereas the twist nock 10 puts an instant spin on the arrow when the twist nock 10 leaves the bow string. The instant spin on the arrow is caused by the twisted opening, whereby the twist nock 10 must twist or spin in order to release itself from the bow string when fired.

A first embodiment 26 is shown in FIG. 1. Embodiment 26 is a twist nock 10 mounted to the rear end 18 of the arrow 20 having feathers 28 reduced in length and height. The normal length of a feather of the prior art is four inches and above. The twist nock 10 allows the reduction of the feather length well below the four inches. Successful flights of arrow were made using feathers 28 one-half inch in length. Reduction of the feather length and height reduces cost due to less material for the manufacture of the feather. Also, reduction of the feather length and height reduces the weight added to the arrow and leads to less drag in flight, thereby increasing the flight velocity of the arrow.

Figure 2:
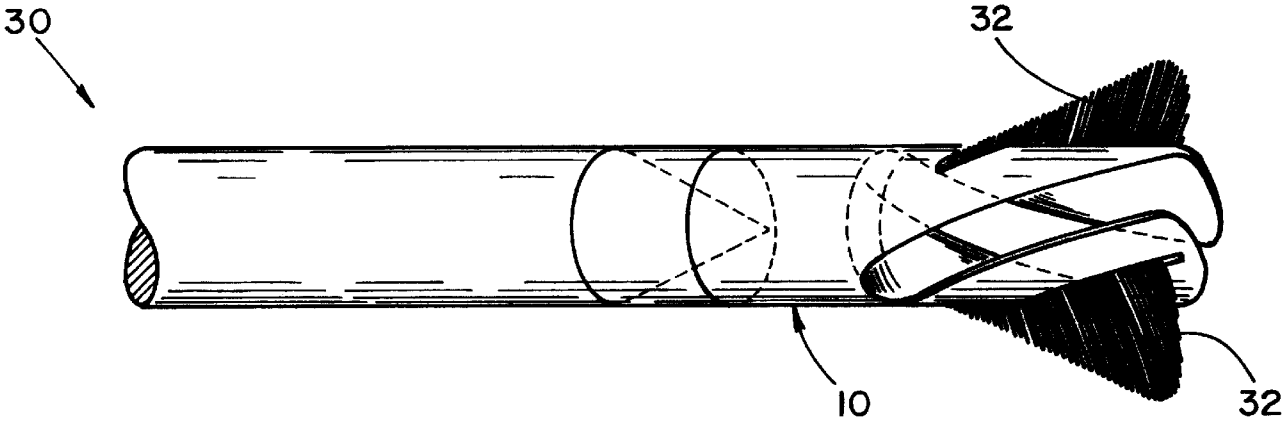
FIG. 2 is perspective view of another embodiment of the present invention.
Figure 4:
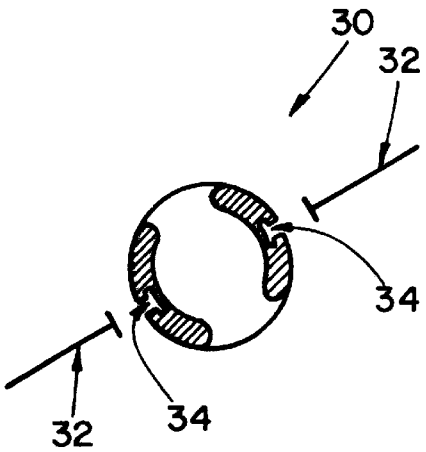
FIG. 4 is a cross-sectional end view of a nock of FIG. 2.
Figure 3:
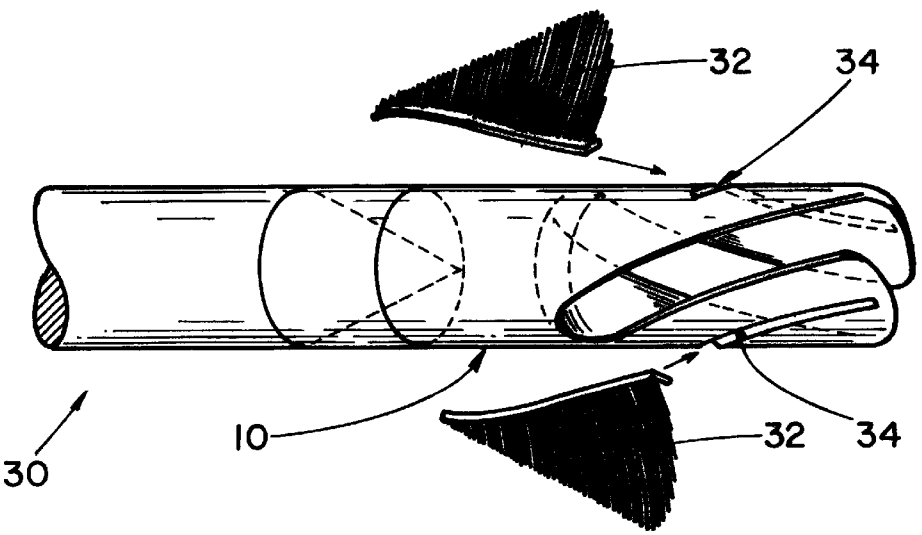
FIG. 3 is an exploded perspective view of FIG. 2.

Another embodiment 30 is shown in FIGS. 2–4. Embodiment 30 is a twist nock 10 with small feathers 32 mounted on the twist nock 10. The feathers 32 are mounted on the rear end 14 of the twist nock 10 on either side of the slot 22. The small feathers 32 are shown tracking along the twisted nock 10 in a similar fashion to the edges 21 of the slot 22. The small feathers 32 provide the stabilizing effect that the feathers on the rear of an arrow provide during flight. The twist nock 10 is show with grooves 34 in the rear end 14 of the twist nock 10, so that the small feathers 32 can be glued into the twist nock 10 instead of being fletched to it or an arrow. The small feathers 32 reduce cost due to less material for the manufacture of the feather. Reduction of the feather size reduces the weight added to the arrow and leads to less drag in flight, thereby increasing the flight velocity of the arrow. Finally, the ability to glue the small feathers 32 into the grooves 34 over fletching feathers on an arrow reduces production costs of the arrow.

Figure 5:
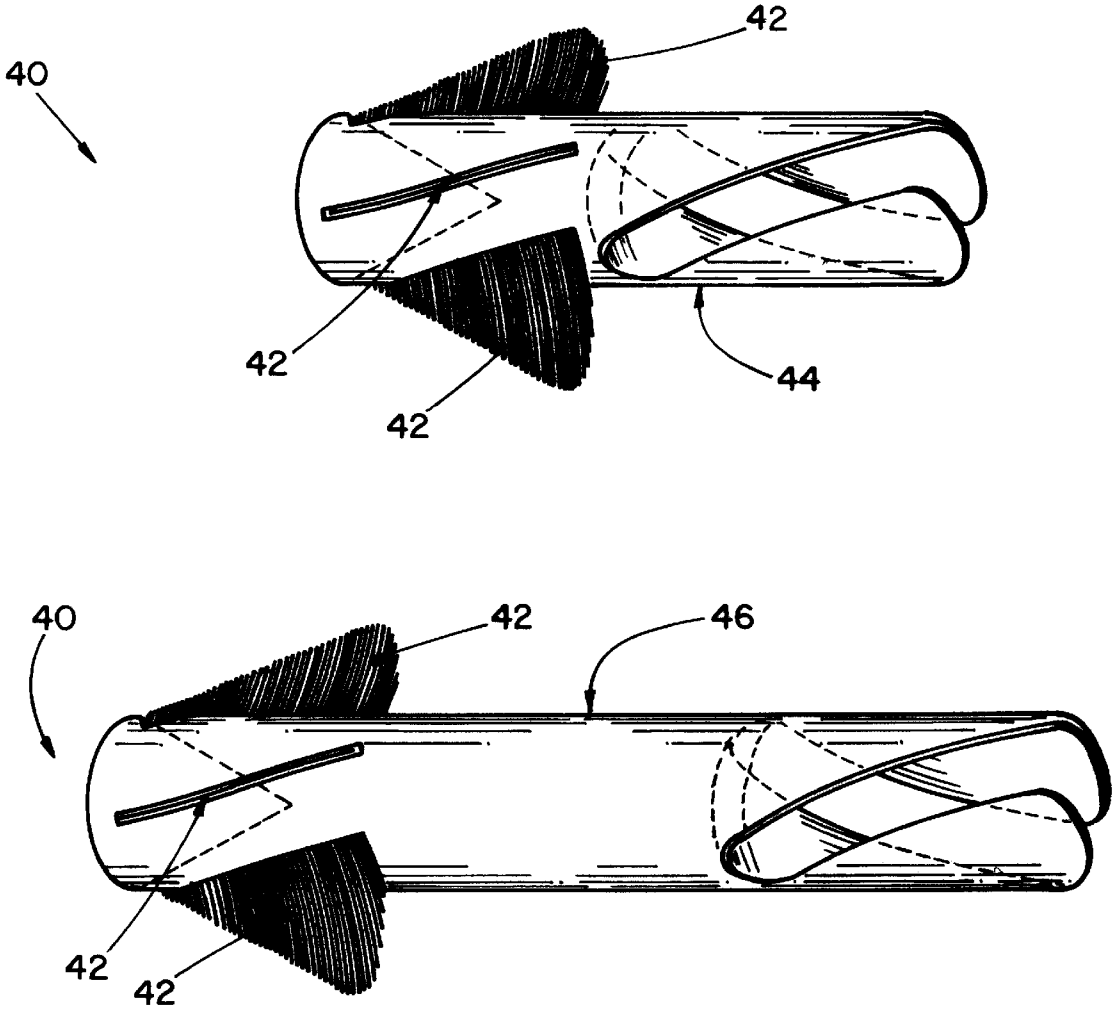
FIG. 5 is comparison perspective view of another embodiment of the present invention.
Figure 6:
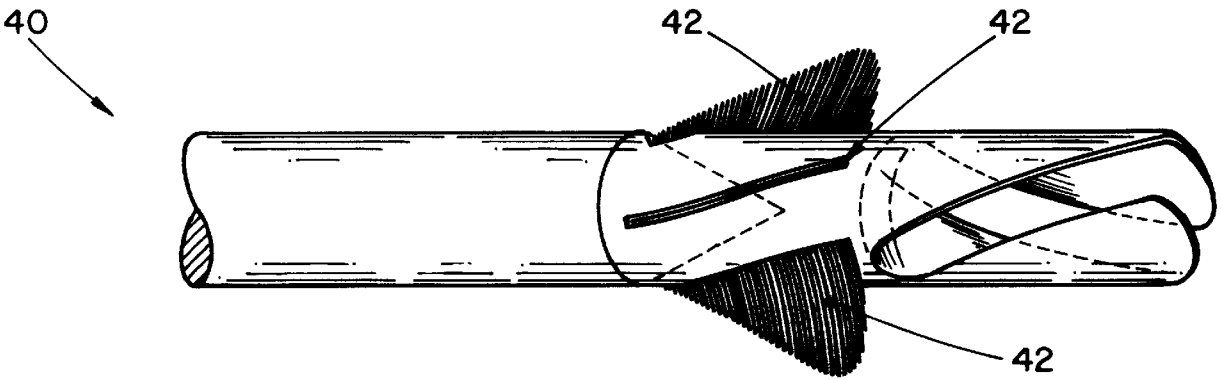
FIG. 6 is perspective view of the embodiment of FIG. 5.
Figure 7:
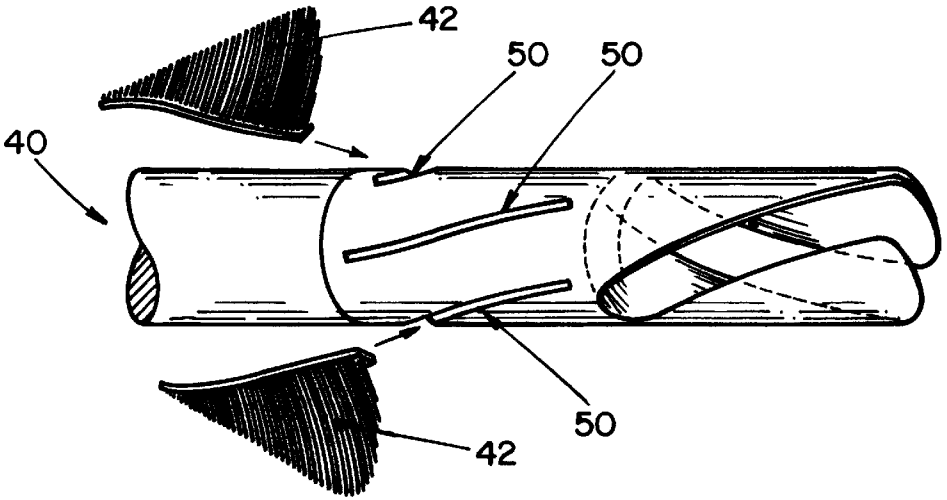
FIG. 7 is an exploded perspective view of FIG. 6.
Figure 8:
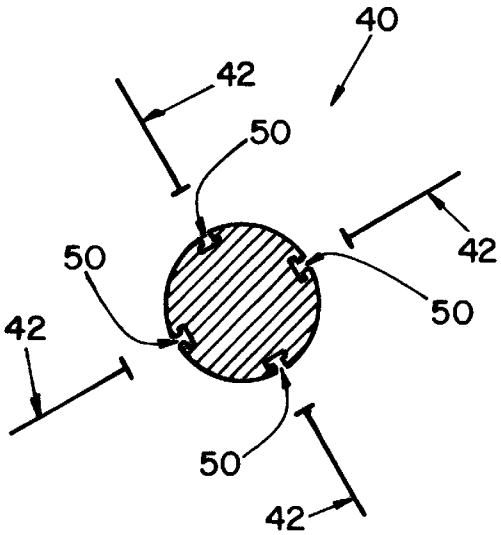
FIG. 8 is a cross-sectional end view of a nock of FIG. 6.

Another embodiment 40 is shown in FIGS. 5–7. Embodiment 40 is a twist nock 10 with small feathers 42 mounted on the front end 12 of the twist nock 10. Two versions of the twist nock 10 for this embodiment are shown, which are a short version 44 and a long version 46. The different between the short version 44 and long version 46 is that the long version 46 has more distance between the slot 22 and a rear end 48 of the small feathers 42. The long version 46 allows more room for the placement of a user's fingers when holding the twist nock 10 on the bow string. The small feathers 42 are shown tracking along the twisted nock 10 in a similar fashion to the edges 21 of the slot 22. The small feathers 42 provide the stabilizing effect that the feathers on the rear of an arrow provide during flight. The twist nock 10 is shown with grooves 50 in the front end 12 of the twist nock 10, so that the small feathers 42 can be glued into the twist nock 10 instead of being fletched to it or an arrow. The small feathers 42 reduce cost due to less material for the manufacture of the feather. Reduction of the feather size reduces the weight added to the arrow and leads to less drag in flight, thereby increasing the flight velocity of the arrow. Finally, the ability to glue the small feathers 42 into the grooves 50 over fletching feathers on an arrow reduces production costs of the arrow.

While different embodiments of the invention has been described in detail herein, it will be appreciated by those skilled in the art that various modifications and alternatives to the embodiments could be developed in light of the overall teachings of the disclosure. Accordingly, the particular arrangements are illustrative only and are not limiting as to the scope of the invention which is to be given the full breadth of any and all equivalents thereof.

I claim:

1. A nock for an archery arrow comprising;

a front end adapted to fit on an arrow;

a rear end;

a surface area between said front and rear ends;

a slot in said rear end forming open areas between two rear surfaces in said rear end, said slot having two edges which define said slot and form a twisted pitch for imparting a spinning action on said arrow when fired from a bow, and said twisted pitch defined by the position of a first end of each of said edges in relation to a second end of each of said edges; and at least one feather mounted on each of said two rear surfaces.

2. The nock of claim 1, further including grooves in each of said two rear surfaces to receive said at least one feather.

3. The nock of claim 1, wherein said at least one feather tracks along each of said two rear surfaces in a similar fashion to said edges of said slot.

4. A nock for an archery arrow comprising;

a front end adapted to fit on an arrow;

a rear end;

a surface area between said front and rear ends;

a slot in said rear end forming open areas between two rear surfaces in said rear and, said slot having two edges which define said slot and form a twisted pitch for imparting a spinning action on said arrow when fired from a bow, and said twisted pitch defined by the position of a first end of each of said edges in relation to a second end of each of said edges; and at least two feathers mounted on said surface area.

5. The nock of claim 4, further including grooves in said surface area for each of said feathers to receive said feathers.

6. The nock of claim 4, wherein said feathers track along said surface area in a similar fashion to said edges of said slot.

7. The nock of claim 4, further including a finger area between a rear end of said feathers and said slot.

8. An arrow comprising:

a shaft having a rear end;

a nock mounted on said rear end, said nock including a front end adapted to fit on an arrow; a rear end; a surface area between said front and rear ends; and a slot in said rear end forming open areas between two rear surfaces in said rear end, said slot having two edges which define said slot and form a twisted pitch for imparting a spinning action on said arrow when fired from a bow, and said twisted pitch defined by the position of a first end of each of said edges in relation to a second end of each of said edges; and at least one feather mounted on each of said two rear surfaces.

9. The arrow of claim 8, further including grooves in each of said two rear surfaces to receive said at least one feather.

10. The arrow of claim 8, wherein said at least one feather tracks along each of said two rear surfaces in a similar fashion to said edges of said slot.

11. The arrow of claim 8, wherein said twisted pitch is about ninety degrees per inch.

12. An arrow comprising:

a shaft having a rear end;

a nock mounted on said rear end, said nock including a front end adapted to fit on an arrow; a rear end; a surface area between said front and rear ends; and a slot in said rear end forming open areas between two rear surfaces in said rear end, said slot having two edges which define said slot and form a twisted pitch for imparting a spinning action on said arrow when fired from a bow, and said twisted pitch defined by the position of a first end of each of said edges in relation to a second end of each of said edges; and at least two feathers mounted on said surface area.

13. The arrow of claim 12, further including grooves in said surface area for each of said feathers to receive said feathers.

14. The arrow of claim 12, wherein said feathers track along said surface area in a similar fashion to said edges of said slot.

15. The arrow of claim 12, further including a finger area between a rear end of said feathers and said slot.

* * * * *